United States Patent [19]

Maillet

[11] 4,386,704

[45] Jun. 7, 1983

[54] METHOD OF FORMING PACKS OF ROLLS OF METAL WIRE NETTING

[75] Inventor: Pierre Maillet, Bourbourg, France

[73] Assignee: Trefileries de Bourbourg, Bourbourg, France

[21] Appl. No.: 274,673

[22] Filed: Jun. 17, 1981

[30] Foreign Application Priority Data

Jun. 20, 1980 [FR] France ..... 80 13768

[51] Int. Cl.[3] ..... B65D 19/00; B65D 85/62; B65D 71/00; B65B 21/06

[52] U.S. Cl. ..... 206/597; 53/443; 100/3; 206/391; 206/598; 108/51.1

[58] Field of Search ..... 206/598, 597, 391, 393, 206/389; 108/51.1; 100/3, 4; 53/443, 447

[56] References Cited

U.S. PATENT DOCUMENTS

| | | | |
|---|---|---|---|
| 1,726,927 | 9/1929 | Shaffer | 100/3 |
| 2,630,214 | 3/1953 | Reed | 206/597 |
| 2,721,653 | 10/1955 | Billinger | 206/393 |
| 3,172,533 | 3/1965 | Wright | 206/389 |
| 3,678,845 | 7/1972 | Francois et al. | 100/4 |

*Primary Examiner*—William T. Dixson, Jr.
*Attorney, Agent, or Firm*—Shlesinger, Arkwright, Garvey & Dinsmore

[57] ABSTRACT

A process for forming packs from cylindrical rolls of metal wire netting comprising flattening each of a plurality of the rolls so as to form an elongated body the major axis of which coincides with that of the cylindrical rolls and which body thereby has at least two flat, non-intersecting faces, and stacking the bodies in face-to-face relationship so as to form a pack.

13 Claims, 2 Drawing Figures

METHOD OF FORMING PACKS OF ROLLS OF METAL WIRE NETTING

This invention relates to a netting of metal wire and more particularly a method of storing and handling such nettings.

BACKGROUND

After the manufacture of metal wire netting, it is customary to roll it up into rolls with substantially circular cross-sections. Such a cross-section is obtained even when the netting is rolled up on squared core, the roll becoming circular after a few layers.

For storing and handling packs of such rolls it is possible to proceed in various ways. First of all, rolls can be stacked one upon another with their axes extending in horizontal direction, whereby it is possible to lash and palletize the stacks to facilitate handling. It is also possible to place the rolls in such a way that their axes extend in vertical direction, thereby also lashing and palletizing the stack. Finally, to obtain greater stability, is is possible to form stacks in which the rolls or successive layers are crossed after which the stack is lashed and palletized. Any method of forming stacks however, offers its specific drawbacks.

Since the rolls have circular cross-sections, each pack of rolls contains considerable voids so that the useful storage volume is comparatively low. Consequently, transportation by truck for example is rendered more costly and thus less efficient. Moreover, in the specific case of stacks of crossed rolls, the only possibility consists in forming a square base whose size is governed by the length of the rolls. This limits the employment of trucks with standard dimensions. The roll lengths are 1 mm and 1.20 m, whereas the usual truck dimensions are 2.40 m wide, 2.10 m high, and 12.5 m long.

It is evident that rolls with circular cross-sections do not possess proper stability so that during handling and especially during the packing operation, the security of the workers is not guaranteed.

Finally, for easy handling, the stacks of rolls must be palletized. This means that pallets with different dimensions are required depending on the lengths of the rolls used.

BRIEF DESCRIPTION AND OBJECTS

One object of the invention is to provide a process for forming stacks of rolls of metal wire netting obviating the aforesaid drawbacks.

A further object of the invention to is provide a process which is specifically applicable to a metal wire netting with hexagonal meshes and torsioned wires, characterized in that after a length of netting has been rolled up into a roll, the latter is flattened so as to form an elongated body whose axis coincides with that of the original roll and which possesses at least two plane non-touching surfaces, after which a given number of bodies are piled or stacked by placing them face-to-face so as to form a pack.

Owing to these characteristics, each roll receives proper stability, the stacking being done in such a manner that the flattened faces are in horizontal position. In these conditions, the stacking operation can be performed without any danger, because a pack which has not yet been finished possesses straight away sufficient stability to prevent the rolls from falling down. Moreover, the presence of flattened faces makes it possible to fill up the voids in the stacks so that the total volume of a pack of rolls is lower than with circular rolls. Neither is it any longer necessary to form stacks in which the rolls are disposed in cross layers. Indeed, because of the flattened form of the roll faces, stability is not increased by such a stacking method. Therefore, it suffices to stack the rolls so that their axes are all parallel to one another.

According to another characteristic of the invention, the process consists in flattening each roll so as to form a prismatic body. This body may then comprise more than two flattened faces and preferably each roll will comprise four flattened faces, the roll section then being square.

Rolls possessing this particular shape can be stacked with maximum security, the volumes of these stacks being the lowest comparatively.

In order to avoid deterioration of the netting wire at the corners of each elongated body caused by excessive bending, according to another characteristic of the invention it is advantageous to flatten each roll in such a manner that its longitudinal edges are rounded.

In this regard, it must be noted that it is advantageous that the lateral flattened faces of the prismatic body constitute together approximately 50 to 80% of the area of its total lateral surface.

In order to obtain monobloc packs it is advantageous to lash the flattened rolls after they have been stacked. It must be noted that compared with stacks of rolls with circular cross-sections, only a few bands are necessary which, owing to the invention, allows to save material and manpower.

Finally, a stack of flattened rolls according to the aforesaid process can easily be rendered palletizable by placing, according to another characteristic of the invention, each stack on at least two spaced elongated flattened bodies fixed to the pack.

DESCRIPTION OF THE DRAWINGS

Other features and advantages of the invention will appear in the course of the following description given by way of example and with reference to the annexed drawings in which:

FIG. 1 shows a roll of metal wire netting with hexagonal meshes of the triple torsion type, a type to which the invention can be applied with great benefit. The wire of this netting is made of annealed low-carbon steel wire galvanized after weaving. The final diameter of the wire is approximately 1 mm, the nominal size of each mesh is 31 mm, whereas the width of the netting is approximately 1 m (corresponding to the roll length).

Each roll comprises a length of 50 m of netting and before being submitted to the process according to the invention it has a diameter of 260 mm thereby weighing approximately 27 kg.

It must be noted that the invention is also applicable to other types of metal wires fences or netting, preferably without an additional element at the wire crossings, but comprising for example knot connections, with spiral wires, of the so-called "agricultural type" (netting for small live-stock). It may also be applied to welded fences. But, for the applications of the process according to the invention, it is advantageous that the wire diameter be less than 2 mm and preferably less than 1.5 mm. A simple test by submitting a particular netting to the process of the invention can reveal its fitness for this purpose.

After being rolled up, each roll is submitted to a flattening operation which can be performed in a conventional press. Two opposite sides of the roll can be flattened so that an elongated body is obtained showing two longitudinal faces that are diametrically opposed and connected to each other by slightly curved faces.

Figure 1:
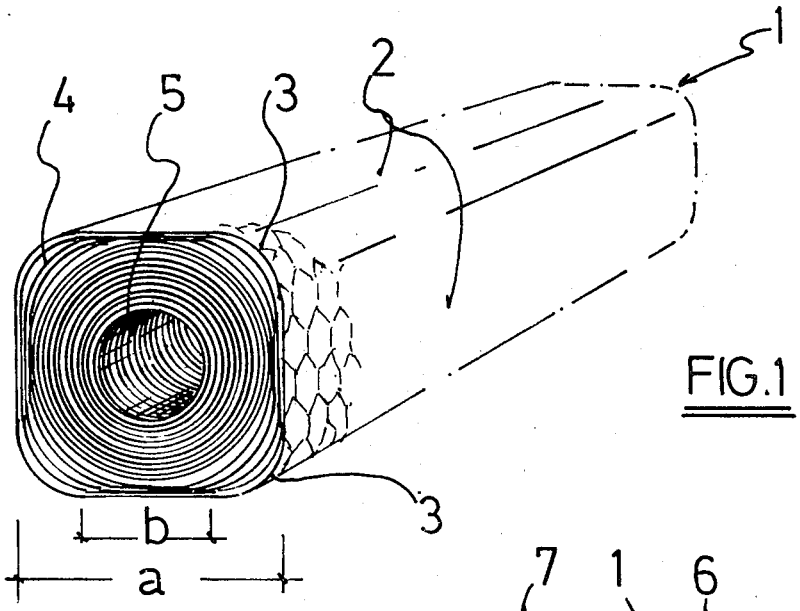
FIG. 1 is a perspective schematic view of a flattened roll which was subjected to the operation recommended by the process of the invention.

Nevertheless, as shown in FIG. 1, the flattening operation should preferably produce a prismatic roll, the latter showing four flattened faces 2 connected to one another by rounded sections 3 which constitute the longitudinal edges of the prismatic body. The latter can easily be obtained in a so-called four-face press. As shown in FIG. 1, only the external roll layers are deformed and the core 4 of the roll 1 keeps its original shape.

If, before being submitted to the process according to the invention, the rolls 1 possess an outer diameter of 270 mm as indicated above, the distance between two opposite faces 2 is 230 mm after they are flattened. This dimension is designated by letter a in FIG. 1. The width b of each flattened face does not correspond to dimension a since the longitudinal edges 3 of the body 1 are rounded. In this way, deterioration of the netting wires due to excessive bending when connecting the lateral faces of the body is avoided. It is advantageous that the ratio of the distance b to the distance a is 50 to 80%, i.e. the width of the flat portion of each side is no more than 50 to 80% of the overall width of the side of body 1, which allows to obtain satisfactory stability for each flattened roll.

It must be noted that with this kind of flattening, the roll keeps an internal passage 5 of circular cross-section. Obviously, the ratio stated above must be selected as a function of certain parameters, such as number of layers in the roll, wire diameter, mesh size, roll-up tension of the roll, etc.

The flat faces 2 can be formed in one operation on a press such as the one described before or also on a continuous installation such as a rolling mill.

Figure 2:
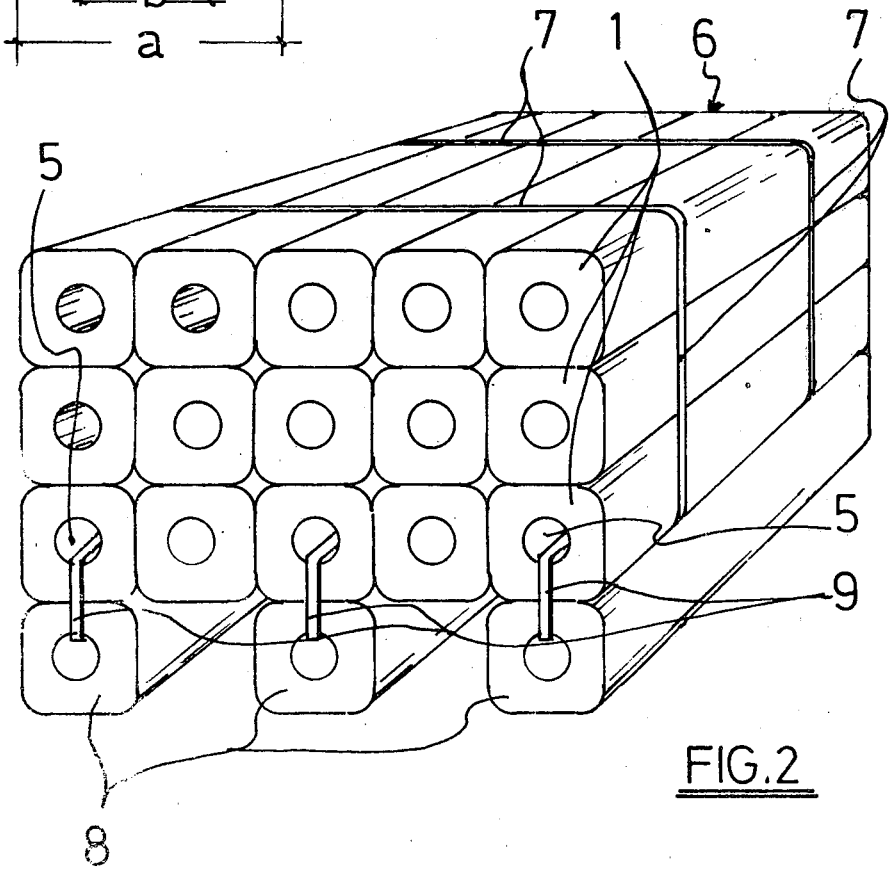
FIG. 2 is a perspective view of a pack of flattened rolls according to the invention.

FIG. 2 shows a pack 6 of rolls 1 according to the invention. In this figure the pack contains 15 rolls distributed in three layers of rolls whose flat faces are disposed against one another. The unit has been lashed by means of bands 7 such as strap irons. To render the pack palletizable it is placed on supplementary rolls 8 along the side of the base of the pack, with possibly a supplementary roll in the middle of this base parallel to the exterior rolls. The supplementary rolls are fixed to pack 6 by means of bands 9 which pass through the passages 5 of the corresponding rolls as shown in FIG. 2.

It is understood that this disposition permits easy handling by means of a fork-lift truck, as if it concerned a flat pallet.

The packs can be placed on top of one another or adjacent to one another without loss of space.

It must be noted that the pack of eighteen rolls 1 is held together by no more than six bands. The total dimensions of the entire pack 6 are the following: height 0.91 m, storage surface 1.03×1.06 m.

A comparable pack with rolls having circular cross-section would contain but rolls held together by seven bands. The dimensions of such a pack are: height 1.00 m, storage surface 1.03 m/1.03 m. It is possible to place the packs on top of one another. If the rolls with circular cross-sections are placed vertically on a pallet, the height of the pack then will be 1.18 m, the storage surface being 1.33/1.55 m. The pack contains 23 rolls, but placing such pallets on top of one another is not without danger, even in a warehouse. In proportion to a packing unit ($m^3$, for example), the pack of flattened rolls according to the invention contains an average number of 16.5 rolls per $m^3$.

It must also be noted that the invention can be applied to rolls of whatever lengths and dimensions. A classic pack of the abovesaid type contains no more than 14 rolls per $m^3$, whereas when placing it on a pallet, it contains no more than 12.50 rolls per $m^3$.

A smaller packing unit obviously reduces the cost of shipping the rolls. Indeed, for example a 20-ton truck can receive a load of netting with 31 mm meshes and made of 1 mm galvanized steel wire (an average roll weighing 27 kg) comprising:

(1) 41 packs of rolls according to the invention; or (2) 24 packs of rolls with circular cross-section placed horizontally and in cross layers; or (3) 18 packs of vertical rolls placed on pallets.

It must be noted that the first quantity is limited not by the available place in the truck, but by the maximal pay load of the latter, the total amount of 41 packs weighing approximately 19,930 kg.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A method of forming stable coils of wire fabric, comprising the steps of:

a. spirally winding a length of said fabric into a substantially cylindrical coil having an axially extending core structure and a plurality of spiral layers; and, b. deforming said coil into a stable substantially prismatic body having at least two substantially flat non-adjacent axially extending faces having rounded edges therebetween while maintaining said core structure in said deformed stable coil.

2. A method of forming stable coils of wire fabric as defined in claim 1, wherein:

a. said core structure includes an axially extending central aperture.

3. A method of forming stable coils of wire fabric as defined in claim 1, further comprising the steps of:

a. deforming said coil into a stable substantially prismatic body having four substantially flat faces, two of said faces being parallel to each other and perpendicular to said other faces, said other faces being parallel to each other, and said coil having rounded edges between said four faces while maintaining said core structure in said deformed coil.

4. A method of forming stable coils of wire fabric as defined in claim 1, wherein:

a. each of said faces flat portion width equals approximately 50% to 80% of said coil width.

5. A method of forming stable coils of wire fabric as defined in claim 1, further comprising the steps of:

a. forming a number of said coils into a first layer wherein the core structure of each of said coils is parallel to the core structure of each of said other coils;

b. forming a number of said layers one upon the other into a substantially rectangular pallet-type package wherein said core structure of each of said coils is parallel to said core structure of said coils adjacent said coils; and, c. securing said layers one to another by means of a number of bands extending circumferentially around said package exterior transverse to said core structures.

6. A method of forming stable coils of wire fabric as defined in claim 5, further comprising the steps of:

a. placing another two of said stable coils in a spaced parallel relationship beneath said package wherein said core structure of each of said spaced coils is parallel to the core structure of said package coil adjacent said coils; and, b. securing said spaced coils to said adjacent coils.

7. A method of forming stable coils of wire fabric as defined in claim 5, further comprising the steps of:

a. placing another three of said coils in a spaced parallel relationship having two equal sized openings beneath said package and wherein said core structure of each of said spaced coils is parallel to the core structure of said package coil adjacent said coils; and, b. securing said spaced coils to said adjacent coils.

8. The product of the process of claim 1.

9. The product of the process of claim 3.

10. The product of the process of claim 4.

11. The product of the process of claim 5.

12. The product of the process of claim 6.

13. The product of the process of claim 7.

* * * * *